US011357695B1

(12) United States Patent
Reyes

(10) Patent No.: US 11,357,695 B1
(45) Date of Patent: Jun. 14, 2022

(54) FOOT MASSAGING DEVICE WITH FIRST AND SECOND HANDLE ASSEMBLIES

(71) Applicant: Jesus N. Reyes, Moorestown, NJ (US)

(72) Inventor: Jesus N. Reyes, Moorestown, NJ (US)

( * ) Notice: Subject to any disclaimer, the term of this patent is extended or adjusted under 35 U.S.C. 154(b) by 272 days.

(21) Appl. No.: 16/160,627

(22) Filed: Oct. 15, 2018

Related U.S. Application Data

(60) Provisional application No. 62/571,991, filed on Oct. 13, 2017.

(51) Int. Cl.
*A61H 15/00* (2006.01)

(52) U.S. Cl.
CPC ..... *A61H 15/0092* (2013.01); *A61H 2205/12* (2013.01)

(58) Field of Classification Search
CPC ..... A61H 15/0092; A61H 15/0085; A61H 15/0078; A61H 15/00; A61H 2015/0007; A61H 2015/0042; A61H 2015/005; A61H 2015/0057; A61H 2015/0064; A61H 2015/0071; A61H 19/32; A61H 19/00; A61H 39/04; B26B 13/06; B26B 13/08; B26B 13/10; B26B 13/005; B26B 13/04; B26B 13/12; A61F 2005/414; A61F 6/204; A61F 6/206; A61F 5/41; A63B 23/035; A63B 23/16
See application file for complete search history.

(56) References Cited

U.S. PATENT DOCUMENTS 1,400,547 A * 12/1921 Holmstrom ..... A61H 15/0092 601/125
2,223,263 A 11/1940 Michaelson
4,930,219 A * 6/1990 Nadeau ..... B26B 13/10 30/230

(Continued)

OTHER PUBLICATIONS

PowerJGym ("What is the PowerJGym?", Web page <http://www.jelqgym.com/jelq-device-power-j-gym.html>, 5 Pages, Jul. 27, 2016, retrieved from Internet Archive Wayback Machine <https://web.archive.org/web/20160727173830/http://www.jelqgym.com/jelq-device-power-j-gym.html> on Oct. 14, 2020) (Year: 2016).*

(Continued)

*Primary Examiner* — Joseph D. Boecker
*Assistant Examiner* — Brian T Khong
(74) *Attorney, Agent, or Firm* — Cramer Patent & Design, PLLC; Aaron R. Cramer

(57) ABSTRACT

A massaging device includes a first arm having a first arm-first end and a first arm-second end and a second arm connected to the first arm and having a second arm-first end and a second arm-second end. The device also includes a first massaging assembly secured to the first arm-first end and a second massaging assembly secured to the second arm-first end. The device also includes a first handle assembly secured to the first arm-second end and a second handle assembly secured to the second arm-second end. Application of a first force on the first handle assembly and the second handle assembly increases a distance between the first massaging assembly and the second massaging assembly.

(Continued)

Application of a second force on the first handle assembly and the second handle assembly decreases the distance between the first massaging assembly and the second massaging assembly.

3 Claims, 1 Drawing Sheet

(56) References Cited

U.S. PATENT DOCUMENTS 5,195,245 A * 3/1993 Malone ..... B26B 13/06 30/195
5,366,475 A * 11/1994 Voss ..... A61H 39/04 606/204
5,632,721 A * 5/1997 Kuan ..... A61H 39/04 601/112
5,643,182 A * 7/1997 Engel ..... A61H 15/0092 601/119
5,766,210 A 6/1998 Komoroczy et al.
5,792,081 A * 8/1998 Cross ..... A61H 15/0092 601/123
6,241,696 B1 * 6/2001 York ..... A61H 15/0092 601/131
6,607,499 B1 8/2003 Becher
6,685,660 B1 * 2/2004 Taverna ..... A61H 39/04 601/81
6,708,699 B2 3/2004 McGriff, III
2002/0183661 A1 * 12/2002 Yoo ..... A63B 22/20 601/23
2004/0254508 A1 * 12/2004 Lee ..... A61H 7/003 601/119
2007/0249975 A1 * 10/2007 Pan ..... A61H 15/0092 601/118
2009/0235688 A1 * 9/2009 Oh ..... A61H 39/04 63/14.1
2011/0270013 A1 * 11/2011 Labash ..... A61H 39/04 600/15
2012/0253248 A1 * 10/2012 Carlson ..... A61H 15/00 601/128
2013/0172792 A1 * 7/2013 Tao ..... A61H 15/0078 601/116
2013/0172794 A1 * 7/2013 Tao ..... A61H 9/0078 601/122
2014/0228722 A1 * 8/2014 Nelson ..... A61H 15/00 601/125
2014/0288473 A1 9/2014 Matsushita
2016/0015594 A1 * 1/2016 Mercado Diaz ..... A61H 19/32 601/138
2016/0235613 A1 * 8/2016 Waldman ..... A63B 21/0552
2016/0296415 A1 * 10/2016 Cross ..... A61H 15/0092
2017/0020772 A1 * 1/2017 Kopnicky ..... A61H 15/00
2017/0042764 A1 * 2/2017 Tima ..... A61N 1/0456
2017/0151126 A1 * 6/2017 Kong ..... B62J 1/007

OTHER PUBLICATIONS

Roller massage system. Patent [online]. Google patents. [Retrieved on Nov. 16, 2016] <URL: https://www.google.com/patents/EP2775985A1?cl=en>.

* cited by examiner

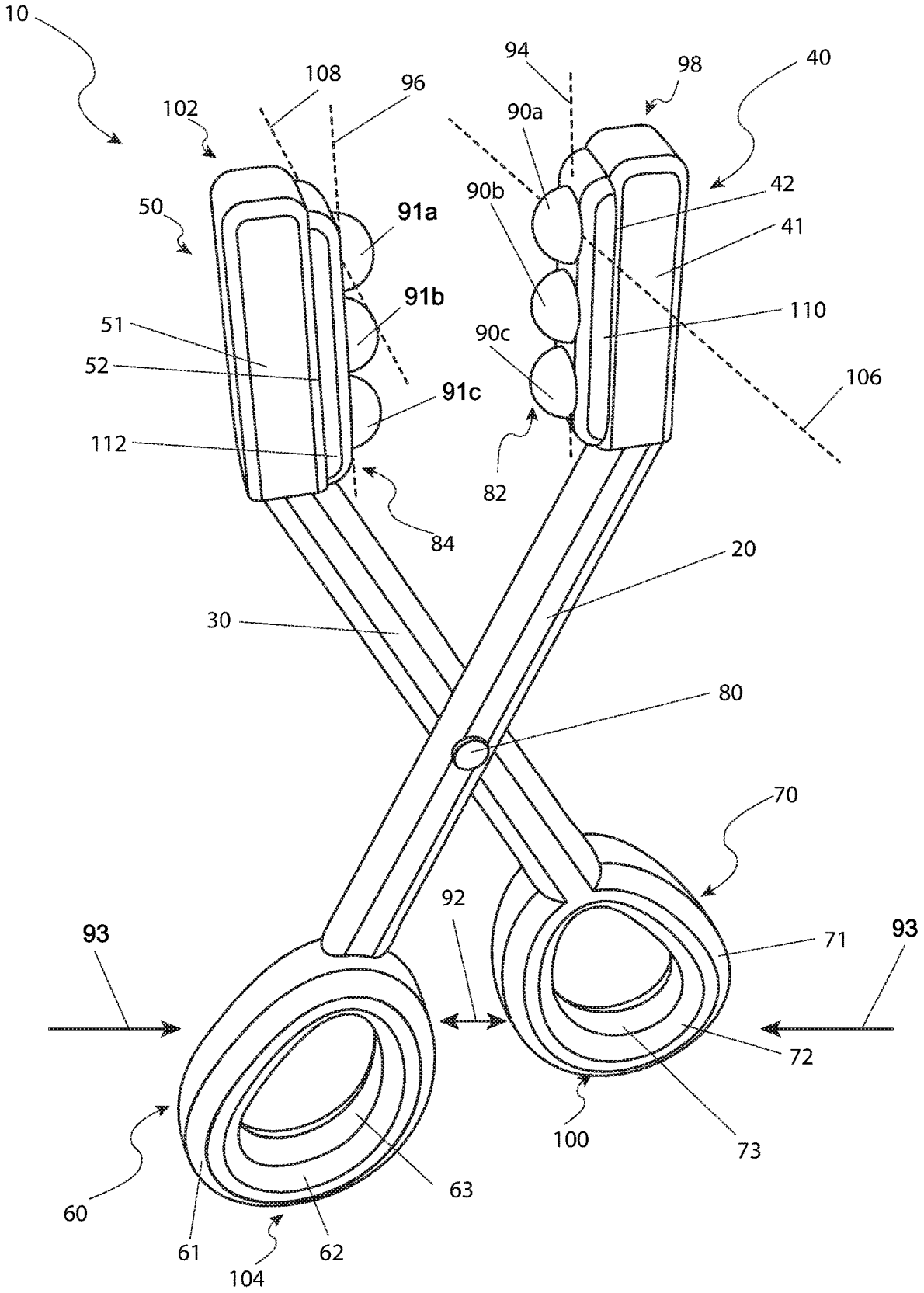
10
102
108
96
94
98
40
90a
42
90b
41
50
91a
91b
110
51
90c
52
91c
106
112
82
84
20
30
80
70
92
93
71
93
72
100
73
60
63
61
62
104

FOOT MASSAGING DEVICE WITH FIRST AND SECOND HANDLE ASSEMBLIES

RELATED APPLICATIONS

The present invention is a continuation-in-part of and claims the benefit of U.S. Provisional Application No. 62/571,991 filed on Oct. 13, 2017, the entire disclosures of which are incorporated herein by reference.

FIELD OF THE INVENTION

The present invention relates to massage devices and, more particularly, to a device for massaging the foot of a user.

BACKGROUND OF THE INVENTION

In today's fast-paced world, it is not uncommon for people who continually work on their feet to complain at the end of a long day about foot pain. This may also be said for those who enjoy walking or running as part of a daily exercise regimen. However, how best to address foot pain is a question that has many answers including medicine, hydrotherapy, cryotherapy and/or massage. While most of these treatments may be easily self-administered, massaging one's feet is a bit more difficult. As a result, various devices have been created that enable a user to massage one's own feet. However, these devices are often bulky and fail to provide an effective massage. Accordingly, there exists a need for a means by which a person may massage his or her feet with ease.

SUMMARY OF THE INVENTION

The inventor has recognized the aforementioned, inherent problems and lack in the art and observed that there is a need for a new and improved device for massaging the foot. The development of the present invention, which will be described in greater detail herein, fulfills this need.

In an embodiment, the disclosed massaging device includes a first arm having a first arm-first end and a first arm-second end and a second arm connected to the first arm and having a second arm-first end and a second arm-second end. The device also includes a fastener connecting the first arm and the second arm together so that the first arm and the second arm pivot about the fastener relative to each other. The device also includes a first massaging assembly secured to the first arm-first end and a second massaging assembly secured to the second arm-first end. The device also includes a first handle assembly secured to the first arm-second end and a second handle assembly secured to the second arm-second end. Application of a first force on the first handle assembly and the second handle assembly increases a distance between the first massaging assembly and the second massaging assembly. Application of a second force on the first handle assembly and the second handle assembly decreases the distance between the first massaging assembly and the second massaging assembly.

Furthermore, the features and advantages described herein may be combined in various manners and embodiments as one skilled in the relevant art will recognize. The embodiment and examples disclosed herein can be practiced without one (1) or more of the features and advantages described in a particular embodiment or example.

Further advantages of the embodiments and examples disclosed herein will become apparent from a consideration of the drawings and ensuing description.

BRIEF DESCRIPTION OF THE DRAWING

The advantages and features of the embodiments and examples disclosed herein will become better understood with reference to the following more detailed description and claims taken in conjunction with the accompanying drawings, in which like elements are identified with like symbols, and in which:

FIG. 1 is a perspective view of an embodiment of the disclosed foot massaging device.

DESCRIPTIVE KEY

10 massaging device
20 first arm
30 second arm
40 first massaging assembly
41 first massaging assembly frame
42 first massaging assembly interior surface
50 second massaging assembly
51 second massaging assembly frame
52 second massaging assembly interior surface
60 first handle assembly
61 first handle assembly exterior
62 first handle assembly median taper
63 first handle assembly interior
70 second handle assembly
71 second handle assembly exterior
72 second handle assembly median taper
73 second handle assembly interior
80 fastener
82 first array of first massaging elements
84 second array of second massaging elements
90 first massaging element
91 second massaging element
92 first force
93 second force
94 first massaging structure-first axis
96 second massaging structure-first axis
98 first arm-first end
100 first arm-second end
102 second arm-first end
104 second arm-second end
106 first massaging structure-second axis
108 second massaging structure-second axis
110 first massaging structure
112 second massaging structure

DETAILED DESCRIPTION OF THE PREFERRED EMBODIMENT

In accordance with the invention, the best mode is presented in terms of the illustrative example embodiments, herein depicted within FIG. 1. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one (1) particular configuration may be shown and described for purposes of clarity and disclosure and not by way of limitation of scope.

As used herein, the singular terms "a," "an," and "the" include plural referents unless the context clearly dictates otherwise. Thus, for example, reference to an object can include multiple objects unless the context clearly dictates otherwise.

As used herein, the terms "connect," "connected," and "connection" refer to a coupling or linking. Connected objects can be directly coupled to one (1) another or can be indirectly coupled to one (1) another, such as via another object.

As used herein, the terms "first," "second," etc. are used merely as labels and do not impose any positional or hierarchical requirements on the item to which the term refers.

As used herein, relative terms, such as "inner," "interior," "outer," "exterior," "top," "bottom," "front," "rear," "back," "left," "right," "upper," "lower," "inside," "outside," "upwardly," "downwardly," "vertical," "vertically," "lateral," "laterally," "above," "below," and similar terms reference relative example positions and/or orientations of the item, element, or feature to which the term refers, for example, as illustrated in the accompanying drawings, but may or may not require a particular position and/or orientation during manufacture and/or use.

In the following description, various illustrative embodiments of the disclosed electrical junction box are provided, which may be practiced without some or all of the particular elements associated with any one (1) of the disclosed embodiments. In some instances, details of known devices and/or processes have been omitted to avoid unnecessarily obscuring the disclosure. While some examples will be described in conjunction with specific illustrated embodiments, these examples are not intended to be limiting. As such, reference herein to "an embodiment," "another embodiment," "an example," and "another example" means that one (1) or more element described in connection with that embodiment or example is included in at least one (1) implementation of the disclosed electrical junction box.

Referring generally to FIG. 1, disclosed is a massaging device (hereinafter referred to as the device 10, where like reference numerals represent similar or like parts. Generally, the disclosed device 10 enables a user to easily and effectively massage various body parts, such as his or her feet or other extremities, while benefiting from the use of copper therapy.

An example of the disclosed device 10 includes a first arm 20 secured to a second arm 30 by a central fastener 80 configured to allow each arm 20, 30 to pivot relative to the other. A first massaging assembly 40 is disposed on (e.g., located at or secured to) a first end 98 of the first arm 20. A first handle assembly 60 is disposed on (e.g., located at or secured to) a second end 100 of the first arm 20, opposite the first massaging assembly 40. A second massaging assembly 50 is disposed on (e.g., located at or secured to) a first end 102 of the second arm 30. A second handle assembly 70 is disposed on (e.g., located at or secured to) a second end 104 of the second arm 30, opposite the second massaging assembly 50.

In an example, application of a first force 92 on the first handle assembly 60 and the second handle assembly 70 increases a distance between the first massaging assembly 40 and the second massaging assembly 50. Inversely, application of a second force 94, opposite the first force 92, on the first handle assembly 60 and the second handle assembly 70 decreases the distance between the first massaging assembly 40 and the second massaging assembly 50.

In an example, the first massaging assembly 40 includes a first massaging assembly frame 41 having, or being connected to, a first massaging assembly interior surface 42. The first massaging assembly 40 also includes a first massaging structure 110 located on the first massaging assembly interior surface 42. In an example, the first massaging structure 110 includes at least one (1) first massaging element 90A, 90B, 90C, etc., also identified individually or collectively as first massaging element(s) 90. The first massaging element 90 projects outward from the first massaging assembly interior surface 42.

In an example, the first massaging structure 110 includes a first array 82 of first massaging elements 90. Each one (1) of the first massaging elements 90 of the first array 82 projects outward from the first massaging assembly interior surface 42. In an example, all of the first massaging elements 90 of the first array 82 are linearly aligned with each other along a first massaging structure-first axis 94 of the first massaging structure 110. In another example, at least one (1) of the first massaging elements 90 of the first array 82 is linearly offset relative to at least another one (1) of the first massaging elements 90 of the first array 82 along the first massaging structure-first axis 94 of the first massaging structure 110.

In an example, the first massaging element 90 is rotationally fixed relative to the first massaging assembly interior surface 42. In an example, the first massaging element 90 has a semi-circular cross-sectional shape as viewed along the first massaging structure-first axis 94 of the first massaging structure 110. For example, the first massaging element 90 can be semi-spherical in shape or semi-cylindrical in shape. The first massaging element 90 can be fixed to the first massaging assembly frame 41 in any one of various ways. For example, the first massaging element 90 can be mounted on, integrated with, or otherwise affixed to the first massaging assembly interior surface 42.

In an example, the first massaging element 90 is rotatable about the first massaging structure-first axis 94 of the first massaging structure 110 relative to the first massaging assembly interior surface 42. In an example, the first massaging element 90 has a circular cross-sectional shape as viewed along the first massaging structure-first axis 94. For example, the first massaging element 90 can be spherical in shape (e.g., a roller ball) or cylindrical in shape (e.g., a roller). In an example, the first massaging element 90 is, additionally or alternatively, rotatable about a first massaging structure-second axis 106 of the first massaging structure 110, which is perpendicular to the first massaging structure-first axis 94, relative to the first massaging assembly interior surface 42. In an example, the first massaging element 90 has a circular cross-sectional shape as viewed along the first massaging structure-second axis 106. For example, the first massaging element 90 can be spherical in shape (e.g., a roller ball) or cylindrical in shape (e.g., a roller). In another example, the first massaging element 90 is freely rotatable, for example, about any axis, relative to the first massaging assembly interior surface 42. For example, the first massaging element 90 has a spherical shape (e.g., a roller ball). The first massaging element 90 can be rotationally coupled with the first massaging assembly frame 41 in any one (1) of various ways. For example, the first massaging element 90 can be mounted to the first massaging assembly interior surface 42 using rotational fasteners, bearings, ball and socket fittings, and the like.

In an example, the second massaging assembly 50 includes a second massaging assembly frame 51 having, or being connected to, a second massaging assembly interior surface 52. The second massaging assembly 50 also includes a second massaging structure 112 located on the second massaging assembly interior surface 52. In an example, the second massaging structure 112 includes at least one (1) second massaging element 92A, 92B, 92C, etc., also identified individually or collectively as second massaging element(s) 92. The first massaging element 90 projects outward from the first massaging assembly interior surface 42.

In an example, the second massaging structure 112 includes a second array 84 of second massaging elements 91. Each one (1) of the second massaging elements 91 of the second array 84 projects outward from the second massaging assembly interior surface 52. In an example, all of the second massaging elements 91 of the second array 84 are linearly aligned with each other along a second massaging structure-first axis 96 of the second massaging structure 112. In another example, at least one of the second massaging elements 91 of the second array 84 is linearly offset relative to at least another one (1) of the second massaging elements 91 of the second array 84 along the second massaging structure-first axis 96 of the second massaging structure 112.

In an example, the second massaging element 92 is rotationally fixed relative to the second massaging assembly interior surface 52. In an example, the second massaging element 92 has a semi-circular cross-sectional shape as viewed along the second massaging structure-first axis 96 of the second massaging structure 112. For example, the second massaging element 92 can be semi-spherical in shape or semi-cylindrical in shape. The second massaging element 92 can be fixed to the second massaging assembly frame 51 in any one of various ways. For example, the second massaging element 92 can be mounted on, integrated with, or otherwise affixed to the second massaging assembly interior surface 52.

In an example, the second massaging element 92 is rotatable about the second massaging structure-first axis 96 of the second massaging structure 112 relative to the second massaging assembly interior surface 52. In an example, the second massaging element 92 has a circular cross-sectional shape as viewed along the second massaging structure-first axis 96. For example, the second massaging element 92 can be spherical in shape (e.g., a roller ball) or cylindrical in shape (e.g., a roller). In an example, the second massaging element 92 is, additionally or alternatively, rotatable about a second massaging structure-second axis 108 of the second massaging structure 112, which is perpendicular to the second massaging structure-first axis 96, relative to the second massaging assembly interior surface 52. In an example, the second massaging element 92 has a circular cross-sectional shape as viewed along the second massaging structure-second axis 108. For example, the second massaging element 92 can be spherical in shape (e.g., a roller ball) or cylindrical in shape (e.g., a roller). In another example, the second massaging element 92 is freely rotatable, for example, about any axis, relative to the second massaging assembly interior surface 52. For example, the second massaging element 92 has a spherical shape (e.g., a roller ball). The second massaging element 92 can be rotationally coupled with the second massaging assembly frame 52 in any one of various ways. For example, the second massaging element 92 can be mounted to the second massaging assembly interior surface 52 using rotational fasteners, bearings, ball and socket fittings, and the like.

In various examples, the first massaging structure 110 (including the first massaging element 90 or the first array 82) and the second massaging structure 112 (including the second massaging element 92 or the second array 84) are positioned and oriented to face each other such that when the second force 93 is applied to the first handle assembly 60 and the second handle assembly 70, the first massaging structure 110 and the second massaging structure 112 grip a portion of the user's body to be massaged (e.g., the arm, the leg, the hand, the foot, etc.) and the first massaging element 90 and the second massaging element 92 make contact with the user's body. The first array 82 and the second array 84 provide multiple points of contact with the user's body.

In an example implementation of use, each first massaging element 90 and each second massaging element 92 functions within the respective first massaging assembly frame 41 and second massaging assembly frame 51 in a manner similar to how an exposed roller ball applicator is moveable secured within a roller ball applicator housing. The first massaging assembly 40 and the second massaging assembly 50 are positioned such that the first massaging structure 110 and the second massaging structure 112 face inward, toward one another, on opposite sides of the body part being massaged.

In an example, at least one (1) of the first massaging element 90 and/or the second massaging element 92 include (e.g., is at least partially formed of) a copper material. In an example, the first massaging element 90 and/or the second massaging element 92 is solid body made of copper. In an example, the first massaging element 90 and/or the second massaging element 92 is solid body having an exterior layer of copper (e.g., a copper coating). In an example, the first massaging element 90 and/or the second massaging element 92 is hollow body made of copper. In an example, the first massaging element 90 and/or the second massaging element 92 is hollow body having an exterior layer of copper (e.g., a copper coating).

In an example, the first handle assembly 60 includes an oblong ring shaped first handle assembly exterior 61, a first handle assembly median taper 62 and an oblong ring shaped first handle assembly interior 63. Similarly, the second handle assembly 70 includes an oblong ring shaped second handle assembly exterior 71, a second handle assembly median taper 72 and an oblong ring shaped first handle assembly interior 73. The shape of the first handle assembly 60 and the second handle assembly 70 is configured to provide an ergonomic or smooth comfort grip for a finger placed in each by a user to operate the device 10, for example, to apply the first force 92 to position the first massaging assembly 40 and the second massaging assembly 50 around the body part and to apply the second force 93 to grip the body part between the first massaging assembly 40 and the second massaging assembly 50.

In an example implementation, the disclosed device 10 can be utilized in a simple and effortless manner with little or no training. After initial purchase or acquisition of the device 10 a user places one (1) of a finger or a thumb within a respective one (1) of the handle assemblies 60, 70 and exerts an outwardly-directed first force 92 upon both handle assemblies 60, 70, which operates to increase a distance between the first massaging assembly 40 and the second massaging assembly 50. Upon increasing the distance to a suitable length, the user places a body part, such as the foot, (not shown) between the first massaging structure 110 and the second massaging structure and exerts an inwardly-directed second force 93, opposite in direction to the first force 92, thereby contacting the first massaging structure 110 and the second massaging structure 110 with the body part and applying a pressure to body part at a plurality of contact points defined the first massaging elements 90 and the second massaging elements 92. The user then manipulates the device 10 in a variety of directions about the body part until such a time as the user determines the massaging session has achieved its purpose. The use of copper in the first massaging elements 90 and the second massaging elements 92 provides various additional health and well-being benefits to the user when using the device 10 for massage. For example, copper is antimicrobial, and has what's known as an oligodynamic effect on bacteria, which kills microbes, regulates the thyroid, makes bones strong, aids in the formation of new cells, and helps with iron absorption.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

The invention claimed is:

1. A massaging device, consisting of:

a first arm having a first arm-first end and a first arm-second end;

a second arm connected to the first arm and having a second arm-first end and a second arm-second end;

a fastener connecting the first arm and the second arm together so that the first arm and the second arm pivot about the fastener relative to each other;

a first massaging assembly secured to the first arm-first end, the first massaging assembly is rotationally fixed;

a second massaging assembly secured to the second arm-first end, the second massaging assembly is rotationally fixed;

a first handle assembly secured to the first arm-second end;

a second handle assembly secured to the second arm-second end;

wherein application of a first force on the first handle assembly and the second handle assembly increases a distance between the first massaging assembly and the second massaging assembly and application of a second force on the first handle assembly and the second handle assembly decreases the distance between the first massaging assembly and the second massaging assembly;

wherein the first massaging assembly includes a first massaging assembly frame having a first massaging assembly interior surface and a first massaging structure located on the first massaging assembly interior surface;

wherein the first massaging structure includes at least two first massaging elements projecting outward from the first massaging assembly interior surface;

wherein the at least two first massaging elements are rotationally fixed relative to the first massaging assembly interior surface and the at least two first massaging elements have a semi-circular cross-sectional shape as viewed along the first massaging structure-first axis of the first massaging structure;

wherein the at least two first massaging elements are fixed in position while freely rotating in position, wherein each of the at least two first massaging elements have a spherical shape;

wherein the first massaging assembly includes the at least two first massaging elements, the second massaging assembly includes at least two second massaging elements, and each of the at least two first massaging elements and the at least two second massaging elements is made of copper;

wherein the second massaging assembly includes a second massaging assembly frame having a second massaging assembly interior surface and a second massaging structure located on the second massaging assembly interior surface;

wherein the second massaging structure includes the at least two second massaging elements projecting outward from the second massaging assembly interior surface;

wherein the at least two second massaging elements are rotationally fixed relative to the second massaging assembly interior surface;

wherein the at least two second massaging elements have a semi-circular cross-sectional shape along a second massaging structure-first axis of the second massaging structure;

wherein the at least two second massaging elements have a spherical shape;

wherein the at least two first massaging elements are rotatable about a first massaging structure-second axis of the first massaging structure, which is perpendicular to the first massaging structure-first axis, relative to the first massaging assembly interior surface; and wherein each of the at least two first massaging elements have a circular cross-sectional shape as viewed along the first massaging structure-second axis.

2. The device of claim 1, wherein:

the at least two second massaging elements are rotatable about the second massaging structure-first axis of the second massaging structure relative to the second massaging assembly interior surface; and the at least two second massaging elements have a circular cross-sectional shape as viewed along the second massaging structure-first axis.

3. The device of claim 2, wherein:

the at least two second massaging elements are rotatable about a second massaging structure-second axis of the second massaging structure, which is perpendicular to the second massaging structure-first axis relative to the second massaging assembly interior surface; and the at least two second massaging elements have a circular cross-sectional shape as viewed along the second massaging structure-second axis.

* * * * *